US008515628B2

(12) United States Patent
Bettany et al.

(10) Patent No.: US 8,515,628 B2
(45) Date of Patent: Aug. 20, 2013

(54) WORKING MACHINE HITCH ARRANGEMENT

(75) Inventors: Domonic Bettany, Uttoxeter (GB); Miles Pilcher, Uttoxeter (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 0 days.

(21) Appl. No.: 13/423,723

(22) Filed: Mar. 19, 2012

(65) Prior Publication Data

US 2012/0245803 A1 Sep. 27, 2012

(30) Foreign Application Priority Data

Mar. 21, 2011 (GB) ..... 1104719.8

(51) Int. Cl.

| | |
|---|---|
| ***G06F 7/70*** | (2006.01) |
| ***G06F 19/00*** | (2011.01) |
| ***G06G 7/00*** | (2006.01) |
| ***G06G 7/76*** | (2006.01) |

(52) U.S. Cl.
USPC ..... 701/50

(58) Field of Classification Search
USPC ..... 701/50
See application file for complete search history.

(56) References Cited

U.S. PATENT DOCUMENTS

| | | | | |
|---|---|---|---|---|
| 3,969,714 | A * | 7/1976 | Greer | 340/679 |
| 6,233,511 | B1 * | 5/2001 | Berger et al. | 701/50 |
| 7,654,019 | B2 * | 2/2010 | Yeager et al. | 37/468 |
| 2006/0096137 | A1 * | 5/2006 | Hendron et al. | 37/348 |
| 2009/0158625 | A1 | 6/2009 | Pope et al. | |

FOREIGN PATENT DOCUMENTS

| | | | |
|---|---|---|---|
| GB | 2420109 | A | 5/2006 |
| JP | 2088823 | A | 3/1990 |
| JP | 2000328608 | A | 11/2000 |

OTHER PUBLICATIONS

Search Report for GB1104719.8, dated Jul. 20, 2011.

* cited by examiner

*Primary Examiner* — Mary Cheung
*Assistant Examiner* — Frederick Brushaber
(74) *Attorney, Agent, or Firm* — Marshall, Gerstein & Borun LLP

(57) ABSTRACT

A working machine comprising: a working arm; a hitch arrangement attached to the working arm and configured to be removably secured to a working implement; one or more sensors configured to determine an orientation of a working implement secured to the hitch arrangement and to output a signal indicative of the orientation of a working implement secured to the hitch arrangement with respect to gravity; and a control module configured to receive the signal from the one or more sensors and to perform a safety function in response to receipt of the signal such that the safety function is performed if the orientation of a working implement secured to the hitch arrangement with respect to gravity is an unpermitted orientation.

13 Claims, 15 Drawing Sheets

WORKING MACHINE HITCH ARRANGEMENT

Embodiments of the present invention relate to a working machine including a hitch arrangement.

Conventional working machines, such as used in the construction industry, agriculture, mining, earth moving, object handling and the like, for example a backhoe loader, comprise at least one working arm carrying a hitch or coupler arrangement which may be an at least partially automated hitch arrangement and which is configured for a coupling to a working implement. The hitch arrangement typically comprises a hook for coupling to a pin of a working implement such that the hook extends around at least part of the pin. The hitch arrangement also typically comprises a further hook which is configured to receive a further pin of the working implement.

The hitch arrangement may be removable from the working arm and may be coupled to the working arm by an attachment arrangement which is also configured to couple a working implement to the working arm.

The hitch arrangement includes a closure arrangement for the further hook, the closure arrangement being moveable between a closed and an open position with respect to the further hook. When in the closed position, the further pin received by the further hook is prevented from leaving the further hook by the closure arrangement; when in the open position, the further pin received by the further hook is permitted to leave the further hook. The hook and the further hook are arranged such that the pin held by the hook is prevented from leaving the hook when the further pin is received by the further hook. Accordingly, the hitch arrangement can be used to secure a working implement thereto and the working implement can be released by actuation of the closure arrangement and movement of the hitch arrangement with respect to the working implement—to release the pin and further pin from the hook and further hook respectively.

The closure arrangement is driven between the open and closed positions by a closure driving arrangement which is typically a hydraulic or pneumatic closure driving arrangement—although manual arrangements are also known. The closure driving arrangement is operated by an operator actuating a user operable control which is coupled to the closure driving arrangement.

It will be appreciated that if the closure arrangement of the hitch arrangement of the working arm is actuated to adopt the open position when the working arm is in some positions, there is a risk that the working implement will fall out of the hitch arrangement in an undesired and potentially dangerous manner under the force of gravity.

In addition, the closure arrangement of the hitch arrangement of the working arm may be actuated to adopt the open position when the working arm is in a position in which there is no or little risk that the working implement falling out of the hitch arrangement in an undesired manner but the working arm may subsequently be moved to a position in which there is a risk that the working implement will fall out of the hitch arrangement in an undesired and potentially dangerous manner under the force of gravity.

There is, therefore, a need to provide an arrangement in which such problems are resolved.

Prior attempts to solve such problems include arrangements in which the closure arrangement of the hitch arrangement of the working arm is only acutatable to adopt the open position when a hydraulic ram associated with the hitch arrangement is fully extended. However, this does not eliminate the risk of the working implement falling out of the hitch arrangement in an undesired and potentially dangerous manner under the force of gravity.

Embodiments of the present invention seek to ameliorate one or more problems associated with the prior art arrangements.

Accordingly, an aspect of the present invention provides a working machine comprising: a working arm; a hitch arrangement attached to the working arm and configured to be removably secured to a working implement; one or more sensors configured to determine an orientation of a working implement secured to the hitch arrangement and to output a single indicative of the orientation of a working implement secured to the hitch arrangement with respect to gravity; and a control module configured to receive the signal from the one or more sensors and to perform a safety function in response to receipt of the signal such that the safety function is performed if the orientation of a working implement secured to the hitch arrangement with respect to gravity is an unpermitted orientation.

The provision of the sensors and the control module means that the working machine of the present invention is provided with a system that has the intelligence to prevent a working implement falling from the hitch due to the force of gravity in a range of positions. This advantage is achieved by detecting the actual orientation of the working implement rather than relying on a position of an associated component, e.g. a hydraulic ram, of the working machine.

The one or more sensors may include a sensor to determine a likely orientation of the working implement secured to the hitch arrangement by sensing an orientation of the hitch arrangement.

The working arm may comprise a boom and a dipper arm, the hitch arrangement may be attached to a distal end of the dipper arm, and the one or more sensors may comprise a first sensor configured to issue a signal indicative of a position of at least part of the hitch arrangement with respect to the dipper arm, and a senor arrangement configured to issue a signal indicative of a position of the dipper arm and boom with respect to gravity.

The machine may further comprise a user indicator configured to output an indication to a user, wherein the safety function includes changing output indication to the user.

The output may include a visual output.

The output may include an audio output.

The machine may further comprise a user operable control coupled to the hitch arrangement and configured to actuate a closure of the hitch arrangement between an open and a closed position, the closure being adapted to secure a working implement to the hitch arrangement releasably, wherein the safety function includes preventing the closure arrangement from moving from a closed to an open position.

The one or more sensors may include one or more tilt switches.

The one or more sensors may include one or more absolute encoders.

The signal from the one or more sensors may comprise an electrical signal.

The one or more sensors may be configured to determine an orientation of a working implement secured to the hitch arrangement and to output a plurality of signals each indicative of the orientation of a part of the working arm and/or a working implement secured to the hitch arrangement with respect to gravity.

The control module may determine whether the orientation of a working implement secured to the hitch arrangement with respect to gravity is a permitted or unpermitted orientation based on the or each received signal.

The machine may be an excavator or a backhoe loader. Alternatively, the machine may be any other working machine having a working arm, for example a telehandler, a loading shovel or a skid steer loader.

Embodiments of the present invention are described by way of example with reference to the accompanying drawings in which.

Figure 1:
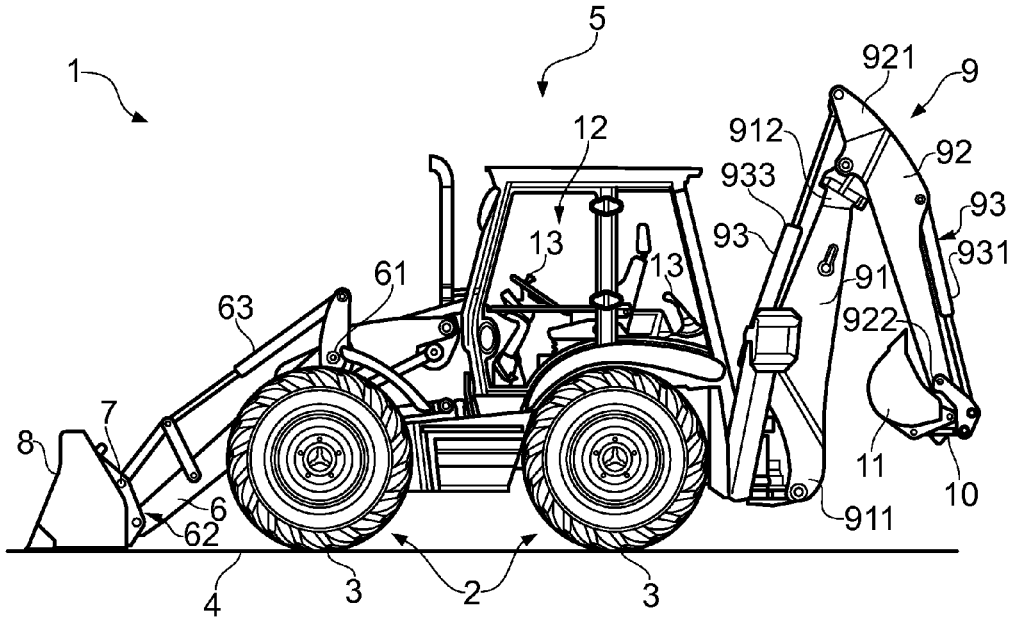
FIG. 1 shows a working machine.
Figure 2:
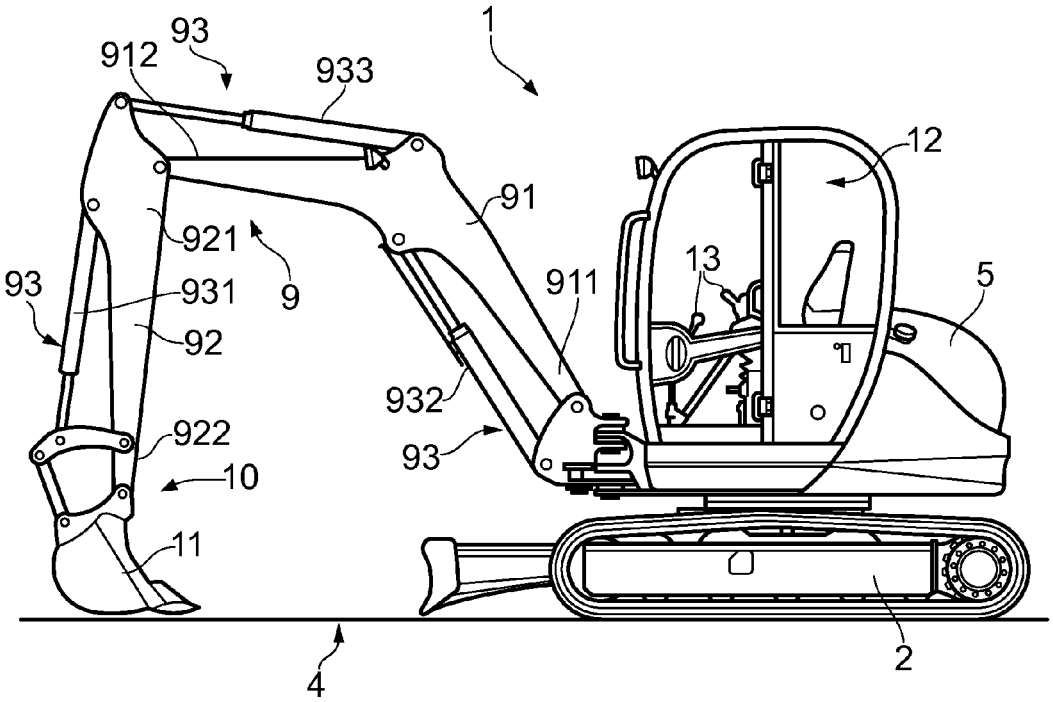
FIG. 2 shows another working machine.

With reference to FIG. 1, an embodiment of the present invention comprises working machine 1, such as a backhoe loader (as shown in FIG. 1) or an excavator (as shown in FIG. 2). The working machine 1 includes a ground engaging arrangement 2 preferably comprising two or more pairs of wheels 3 mounted on respective axles, wherein at least one of the axles is coupled to a driving arrangement which drives rotational movement of at least one of the pairs of wheels 3.

In an embodiment, (see FIG. 1—for example) the two or more pairs of wheels 3 are arranged to engage a ground surface 4 and rotational movement of the or each pair of wheels 3 caused movement of the working machine 1 across the ground surface 4.

It will be appreciated that other ground engaging arrangements 2 may be provided—for example, two or more endless tracks (see FIG. 2—for example).

In an embodiment, (see FIG. 1—for example) the ground engaging arrangement 2 carries a main body 5 of the machine 1 and a first working arm 6 extends forwardly from the main body 5. A proximal end 61 of the first working arm 6 is coupled to the main body 5 and a distal end 62 of the first working arm 6 is configured for connection, by a first hitch arrangement 7, to a first working implement 8.

In embodiments, (see FIG. 1 and FIG. 2—for example) a second working arm 9 may be provided which extends from the main body 5. The second working arm 9 may extend rearwardly (see FIG. 1—for example) or forwardly (see FIG. 2—for example). The second working arm 9 may comprise a boom 91 connected to a proximal end 911 to the main body 5 by a king post or other pivotal arrangement. A distal end 912 of the boom 91 may be connected to a proximal end 921 of a dipper arm 92 by a pivotal arrangement. A distal end 922 of the dipper arm 92 is configured for connection, by a second hitch arrangement 10, to a second working implement 11.

It will be appreciated that embodiments of the present invention may include a working machine 1 with only a second working arm 10 and no first working arm 11 (see FIG. 2 for example).

The first and/or second 10 hitch arrangements may be part of their respective working arm 6,9 or may be removably attached thereto.

In embodiments, the driving arrangement or engine of the machine 1 is housed in the main body 5 of the machine 1 which includes an operator cab 12. The operator cab 12 houses a plurality of user operable controls 13, the actuation of which control the operation of parts of the machine 1.

The first 6 and second 9 working arms are, in an embodiment, coupled to respective hydraulic driving arrangements 63,93 which are configured to drive movement of the first 6 and second 9 working arms with respect to the main body 5 of the machine 1. The hydraulic driving arrangements 63,93 may also drive movement of the hitch arrangements 7, 10 and/or working implements 8,11 with respect to the working arms 6,9.

The hydraulic driving arrangement 93 (see FIGS. 1 and 2) coupled to the second working arm 9 may include a first hydraulic ram 932 configured to drive rotational movement of the boom 91 with respect to the main body 5 of the machine 1 between a first and a second boom position. The hydraulic driving arrangement 93 coupled to the second working arm 9 may include a second hydraulic ram 933 configured to drive rotational movement of the dipper arm 92 with respect to the boom 91 between a first and a second dipper arm position. The hydraulic driving arrangement 93 couples to the second working arm 9 may also include a third hydraulic ram 93 (sometimes known as a bucket ram 931) which is configured to drive rotational movement of the second hitch arrangement 10 and any working implement coupled thereto (such as the second working implement 11) with respect to the dipper arm 92 between a first and a second working implement position (the first working implement position being with the third hydraulic ram 931 fully retracted and the second working implement position being with the third hydraulic ram 931 fully extended). The third hydraulic ram 931 may, in an embodiment, be configured to drive rotational movement of part of the second hitch arrangement 10 and any working implement coupled thereto with respect to the dipper arm 92 between the first and the second working implement position.

One or both of the first 7 and second 10 hitch arrangements may be at least partially automated hitch arrangements 7,10.

The hitch arrangements 7, 10 may, in an embodiment, comprise a hitch attachment arrangement which is configured to be coupled to a corresponding working implement attachment arrangement of a working implement 8,11. Accordingly, the hitch attachment arrangement and the working implement attachment arrangement may be configured to cooperate in order to mate with each other. In an embodiment, the hitch attachment arrangement comprises at least one first hook for coupling to one or more first pins of a working implement attachment arrangement of a working implement 8,11 such that the or each first hook extends around at least part of the circumference of one of the or each of the first pins.

In an embodiment, one or more second hooks or recesses are provided which are each configured to receive one or more second pins of the working implement 8,11.

In an embodiment, the working implement attachment arrangement comprises one or more hooks or recesses configured to receive one or more pins of the hitch attachment arrangement.

In an embodiment, the working implement attachment arrangement comprises one or more hooks or recesses and one or more pins, the or each hook or recess and the or each pin being configured to receive or be received by a respective hook or recess, or pin of the hitch attachment arrangement.

In an embodiment, the one or more second hooks or recesses may be one or more second hooks or recesses of the working implement attachment arrangement or the hitch attachment arrangement. In an embodiment, the one or more second pins may be one or more second pins of the working implement attachment arrangement or the hitch attachment arrangement.

A closure arrangement is provided for the or each second hook or recess, the closure arrangement being moveable between a closed and an open position.

When in the closed position, the or each second pin received by the or each second hook or recess is prevented from leaving the or each second hook or recess by the closure arrangement. When in the open position, the or each second pin received by the or each second hook or recess is permitted to leave the second hook or recess. The or each first hook and the or each second hook or recess are arranged such that the or each first pin held by the or each first hook is prevented from leaving the or each first hook when the or each second pin is received by the or each second hook or recess.

The closure arrangement may comprise one or more moveable bolts which are axially moveable with respect to the or each second hook or recess. The closure arrangement may comprise one or more claws which are rotationally moveable with respect to the or each second hook or recess. It will be appreciated that, in embodiments, the closure arrangement may form part of the hitch attachment arrangement or the working implement attachment arrangement. The closure arrangement need not be provided in combination with a second hook or recess but could be provided in combination with other elements of the attachment arrangements. In an embodiment, a closure arrangement is provided in relation to the first hook or recess and/or the second hook or recess. Reference to a closure arrangement herein refer to the closure arrangement or a plurality of arrangements of a hitch attachment arrangement or working implement attachment arrangement.

Accordingly, the hitch arrangements 7, 10 can be used to secure respective working implements 8,11 thereto and the working implements 8,11 can be released by actuation of the closure arrangement of the relevant hitch arrangement 7,10 and movement of the relevant hitch arrangement 7,10 with respect to the working implement 8,11—to move the pins out of the first hook and the second hook or recess (for example).

The hitch arrangements 7,10 may include one or more locking pins or other locking arrangements (not shown) which are automatically or manually moved into a locked position (from an unlocked position) when the closure arrangement is in the closed position. Similarly, the one or more locking pins or other locking arrangements may be moved from the locked position to the unlocked position when it is desired to move the closure arrangement to the open position. The or each locking pin or other locking arrangements may be arranged such that, in the locked position, movement of the closure arrangement to the open position is substantially prevented by the or each locking pin or other locking arrangement. The or each locking pin or other locking arrangement is, therefore, a safety device which helps to reduce the risk of release of a working implement 8,11 from a hitch arrangement 7,10 at an undesired juncture by the unintentional movement of the closure arrangement to the open position. A pneumatic or hydraulic or electric driving arrangement may be provided for the or each locking pin or other locking arrangements to move the locking pin or other locking arrangement between the locked and unlocked positions (a single driving arrangement may be provided for multiple locking pins or other locking arrangements). A user operable control 13 may be provided, the actuation of which by a user causes movement of the or each locking pin or other locking arrangement between the locked and unlocked positions.

The closure arrangement is preferably driven between the open and closed positions by a closure driving arrangement which may be a hydraulic or pneumatic or electric driving arrangement.

The closure driving arrangement may be moved by an operator actuating a user operable control 13 which may be provided in the operator cab 12 of the machine 1—the user operable control 13 being coupled to the closure driving arrangement and configured to cause movement thereof between the open and closed positions. One or more closure driving arrangements may provided in embodiments of the invention and may be operated by a single user operable control 13. A single closure arrangement may be provided for multiple second hooks or recesses and/or multiple second pins.

As will be understood, therefore, a user can attach or detach the second working implement 11 to or from the second hitch arrangement 10 by controlling the operation of the closure arrangement (and the locking pin or other locking arrangement if provided).

It will be appreciated that a multitude of different hitch arrangements are possible and are compatible with embodiments of the present invention. The above examples are merely some examples of suitable hitch arrangement.

The first 6 and second 9 working arms and their respective hydraulic driving arrangements 63,93 are such that each arm 6,9 can adopt a number of different positions with respect to the main body 5 of the machine 1 during operation.

Figure 3:
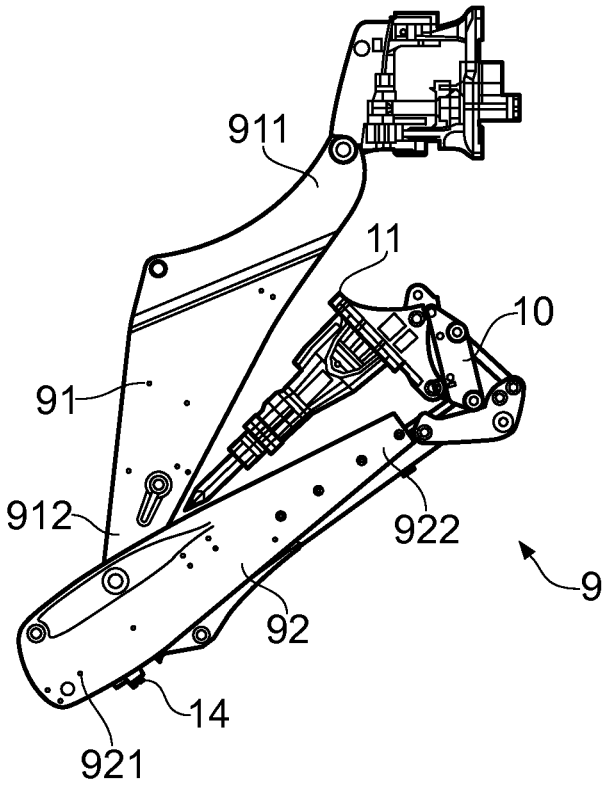
FIGS. 3 and 4 show a working arm.
Figure 4:
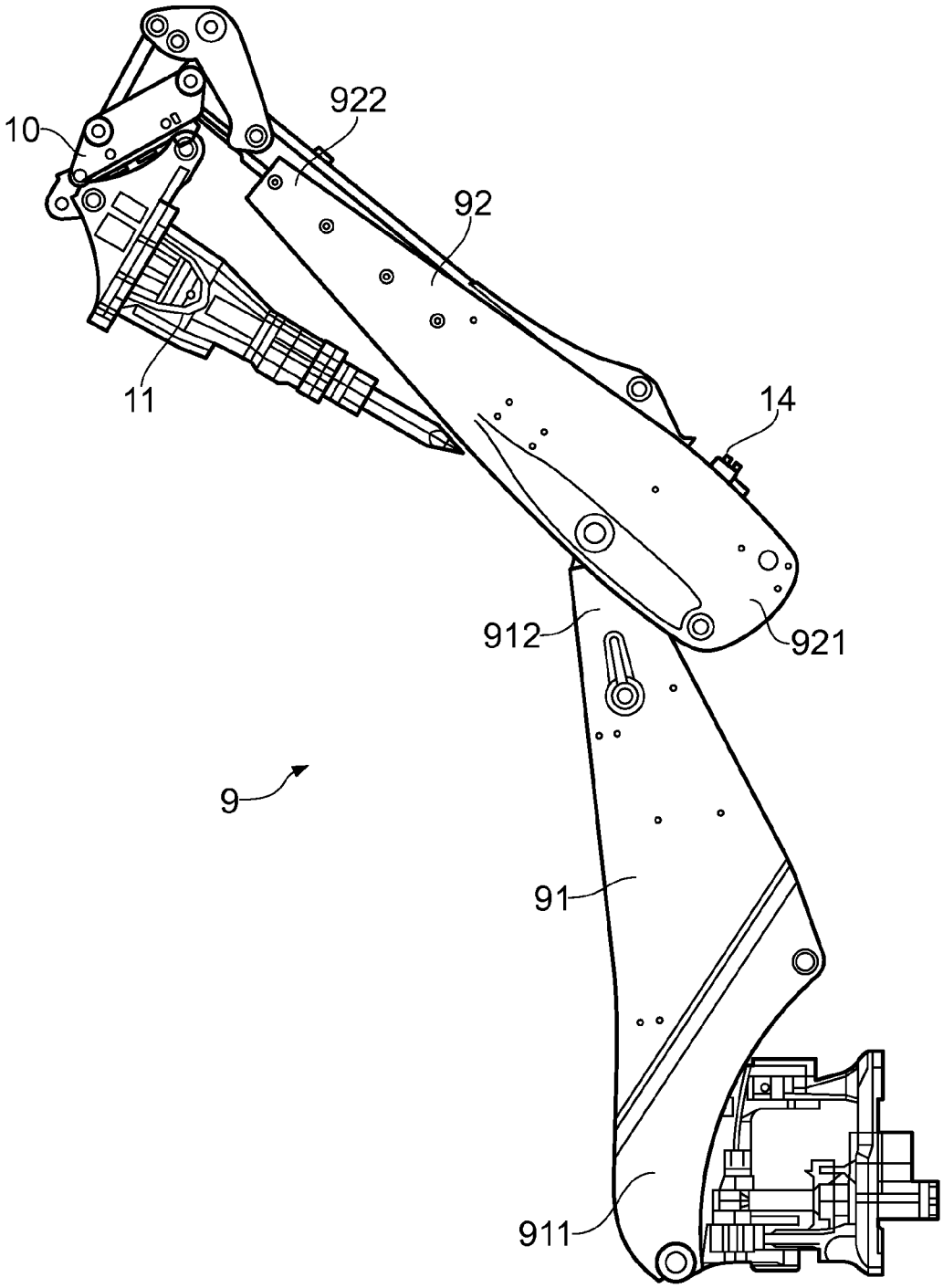
Figure 5:
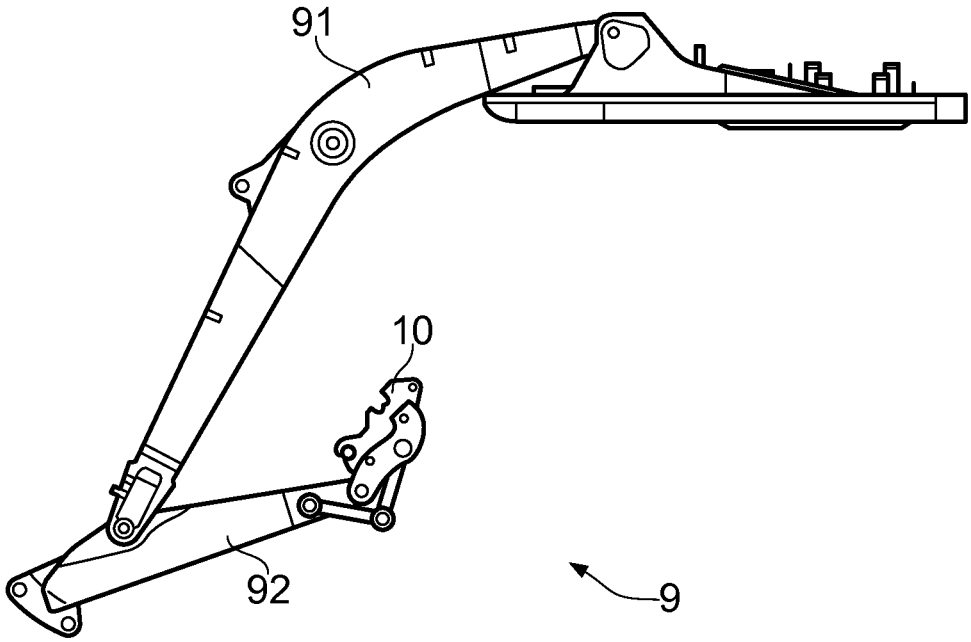
FIGS. 5 and 6 show another working arm.
Figure 6:
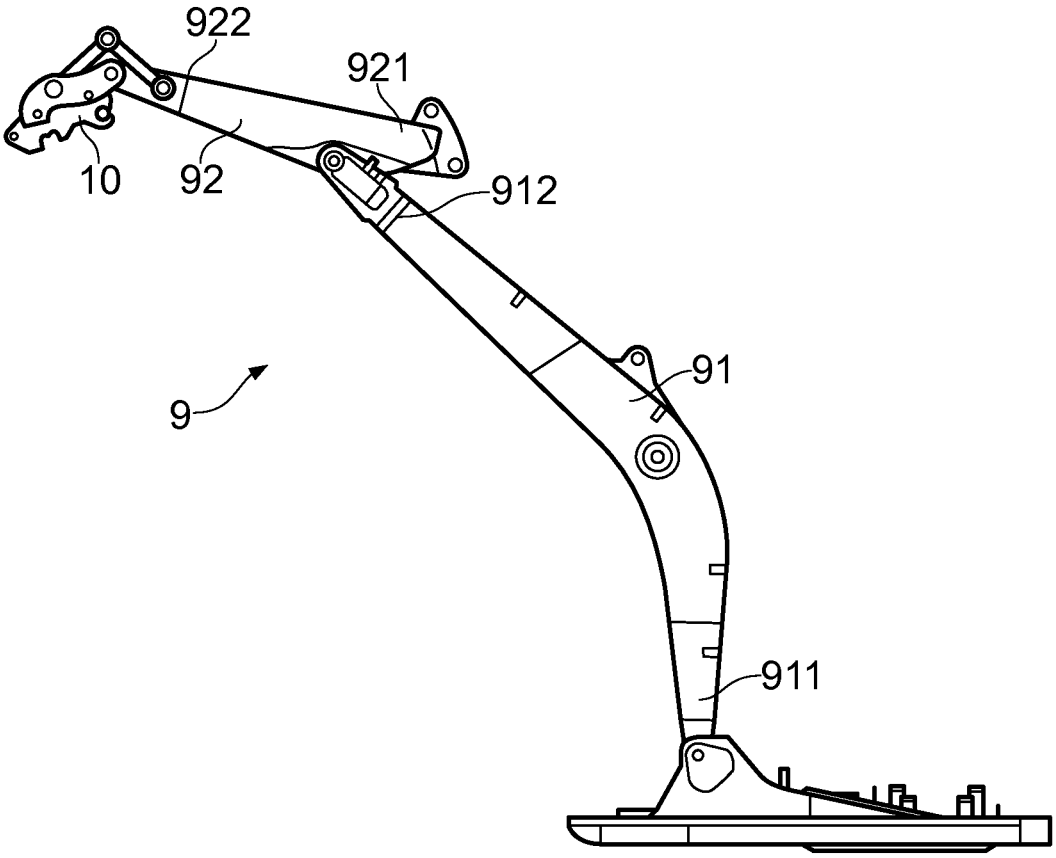

The second working arm 9, for example, may be operable to be moved between a first position shown in FIG. 3 and a second position shown in FIG. 4 in the case of a first type of working machine 1 (such as a backhoe loader), and as shown in FIGS. 5 and 6 in the case of a second type of working machine 1 (such as an excavator). As can be seen from these figures (FIGS. 3 and 4, 5 and 6), the second working implement 11 is in the second working implement position with respect to the dipper arm 92 (i.e. with the third hydraulic ram 931 substantially fully extended) and yet the orientation of the second working implement 11 with respect to the main body 5 of the machine 1 and gravity changes considerably depending on the position of the second working arm 9. The position of the second working arm 9 is, of course, in this example determined by the orientation of the dipper arm 92 with respect to the boom 91 and the orientation of the boom 91 with respect to the main body 5 of the machine 1.

It will be understood that if the closure arrangement of the second hitch arrangement 10 were to be opened in certain orientations of the second working implement 11 with respect to gravity, then the second working implement 11 may fall from the second hitch arrangement 10 under the effect of gravity. This may result in the working implement 11 becoming detached from the second hitch arrangement 10 or may result in the working implement 11 becoming partially detached and moving (e.g. swinging) under the effect of gravity about a part of the second hitch arrangement 10.

Figure 7:
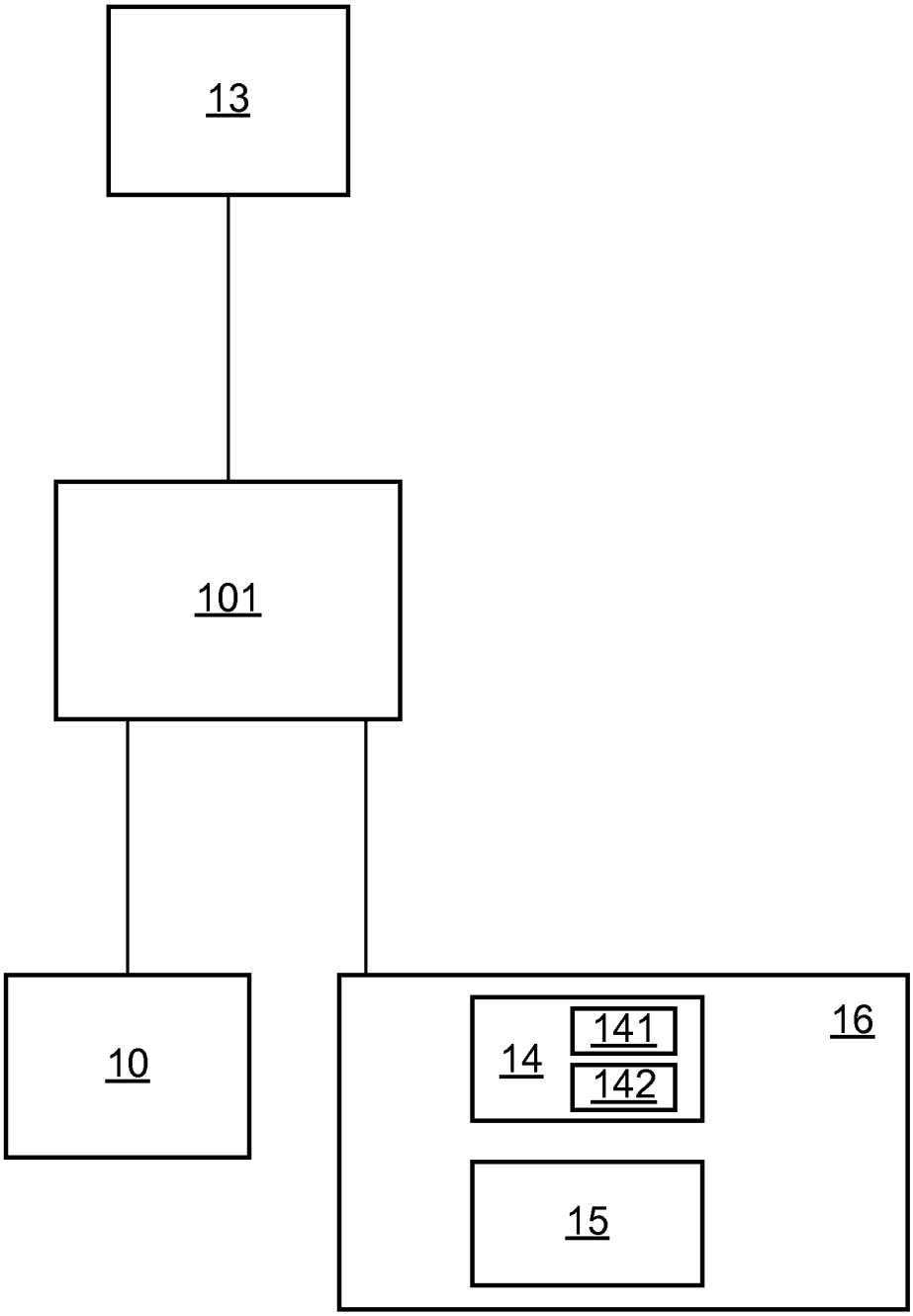
FIG. 7 shows a schematic diagram of an embodiment of part thereof.

In an embodiment of the present invention the second hitch arrangement 10 is coupled to a second hitch arrangement control circuit 101 (see FIG. 7). The second hitch arrangement control circuit 101 is configured to actuate the closure arrangement of the second hitch arrangement 10 between the open and the closed position in response to a signal received from a user operable control 13.

The second hitch arrangement control circuit 101 is further configured, in an embodiment, to receive one or more signals from one or more respective sensors 16. The second hitch arrangement control circuit 101, in this embodiment, is configured to actuate the closure arrangement of the second hitch arrangement 10 from the closed to the open configuration on receipt of the signal from the user operable control 13 (also coupled to the second hitch arrangement control circuit 101) only if the second working arm 9 is in one or more predetermined positions (i.e. a permitted position) and the second working implement 11 is in one or more predetermined positions (i.e. a permitted position). The second hitch arrangement control circuit 101 determines whether the second working arm 9 and the second working implement 11 is in one of these permitted positions based on the one or more signals from the one or more respective sensors 16. The or each sensor 16 is configured to output a signal when that sensor 16 senses that an associated part of the second working arm 9 and/or second hitch arrangement 10 and/or second working implement 11 is in a permitted position. The or each sensor 16 is configured either not to output a signal or to output a different signal when that sensor 16 senses that an associated part of the second working arm 9 and/or second hitch arrangement 10 and/or second working implement 11 is not in a permitted position.

A permitted position is, in general, a position in which it is considered less likely that the second working implement 11 will fall from, or move in an uncontrolled manner (e.g. swing under the effect of gravity) with respect to a part of, the second hitch arrangement 10 in an undesired manner. An unpermitted position is, in general, a position in which it is considered more likely that the second working implement 11 will fall from, or move in an uncontrolled manner (e.g. swing under the effect of gravity) with respect to a part of, the second hitch arrangement 10 in an undesired manner. The position may be an orientation and a permitted position of the second working implement 11 with respect to gravity or the main body 5 of the machine 1 may be an orientation with of the second working implement 11 with respect to the main body 5 of the machine or gravity. As the second working implement 11 is attached to the second hitch arrangement 10, the position of the second working implement 11 may be a position of the second hitch arrangement 10 or may be determined therefrom.

In an embodiment, a permitted position is, in general, a position in which it is considered unlikely that the second working implement 11 will move substantially with respect to the second hitch arrangement 10 and an unpermitted position is, in general, a position in which it is considered likely that the second working implement 11 will move substantially with respect to the second hitch arrangement 10. It will be appreciated that movement of the second hitch arrangement 10 with respect to the second working implement 11 must still be permitted when it is desired to disengage the working implement 11 from the hitch arrangement 10.

In an embodiment of the present invention, a first sensor 15 of the one or more sensors 16 is configured to detect the position of the second working implement 11 or a part thereof with respect to the dipper arm 92. The position may be an orientation. The first sensor may issue a signal only when the second working implement 11 is substantially in the second working implement position with respect to the dipper arm 92 (i.e. with the third hydraulic ram 931 substantially fully extended). The first sensor 15 may, as will be appreciated, sense a position of all or part of the second hitch arrangement 10 and, hence, the position of all or part of the second working implement 11 attached thereto.

The second hitch arrangement control circuit 101 may be configured to actuate the closure arrangement of the second hitch arrangement 10 on receipt of the signal from the first sensor 15 and on receipt of a signal from the user operable control 13 indicating that the user has actuated a user operable control 13 to open the closure arrangement of the second hitch arrangement 10. Without receipt of the signal from the first sensor 15, the second hitch arrangement control circuit 101 may, in an embodiment, not actuate the closure arrangement even if the signal is received from the user operable control 13.

Thus, in this embodiment, the closure arrangement of the second hitch arrangement 10 can only be moved to the open position when the second working implement 11 is substantially in the second working implement position. The second hitch arrangement control circuit 101 may, similarly, be coupled to a driving arrangement of the locking pin or other locking arrangement (if provided) and configured to move the locking pin or other locking arrangement from the locked to the unlocked position in the same manner.

Figure 8:
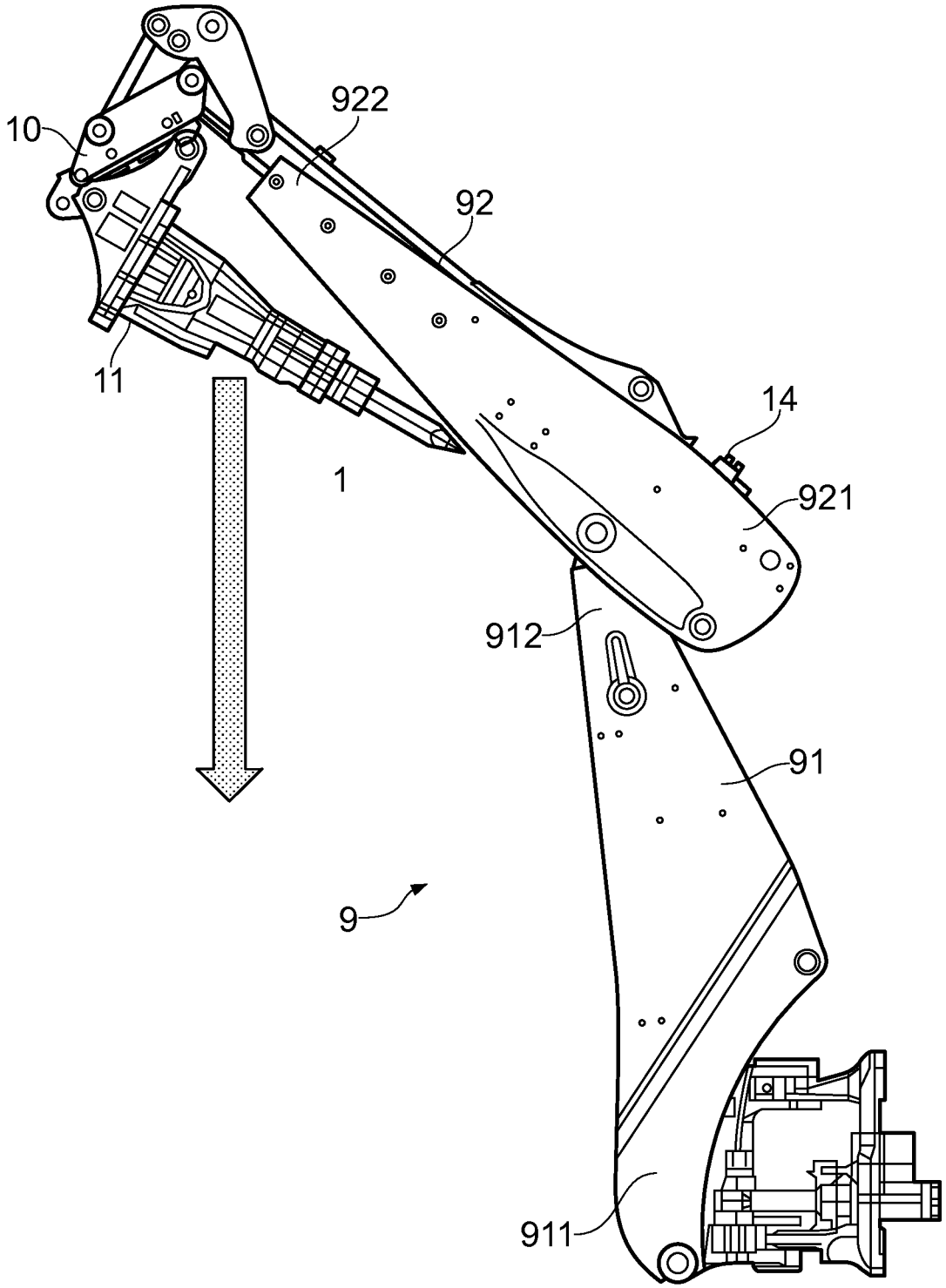
FIGS. 8 to 15 show working arms in various positions.
Figure 9:
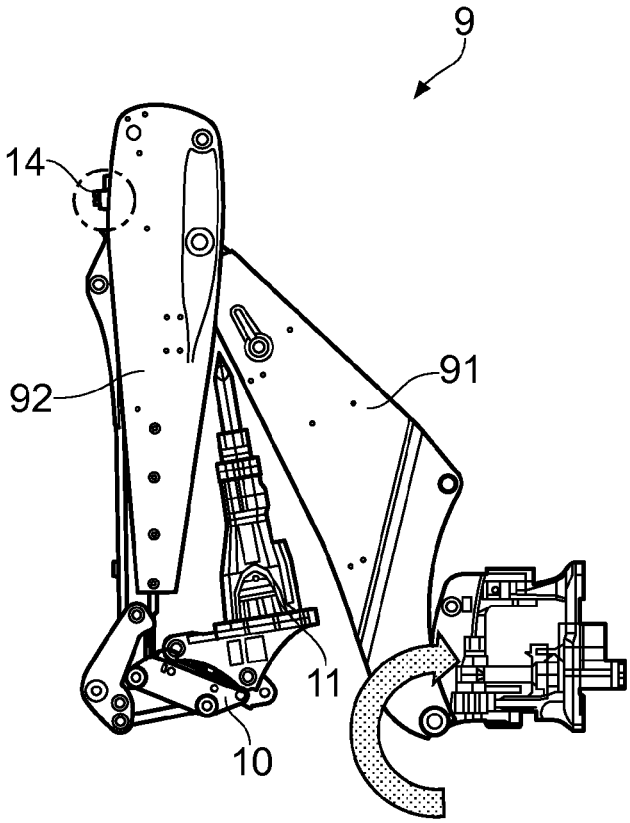
Figure 9A:
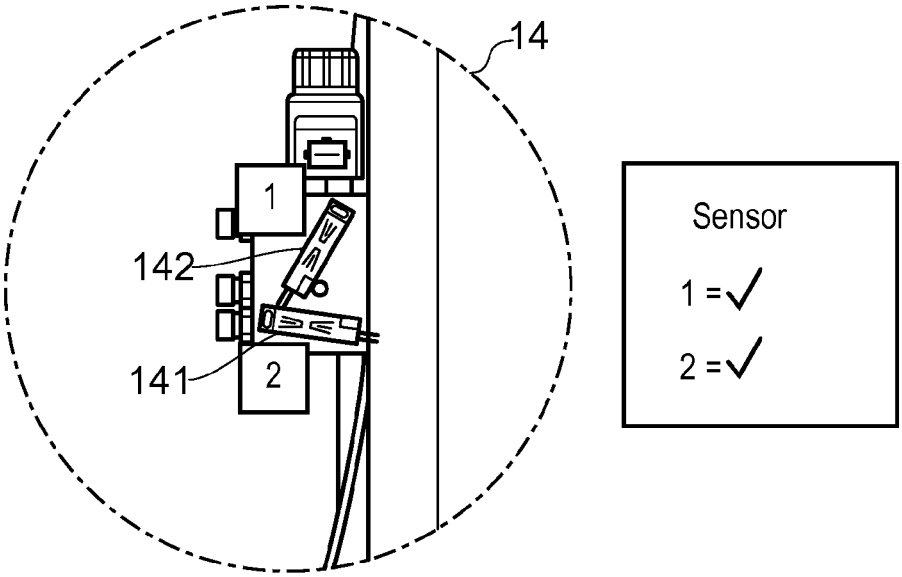
Figure 10:
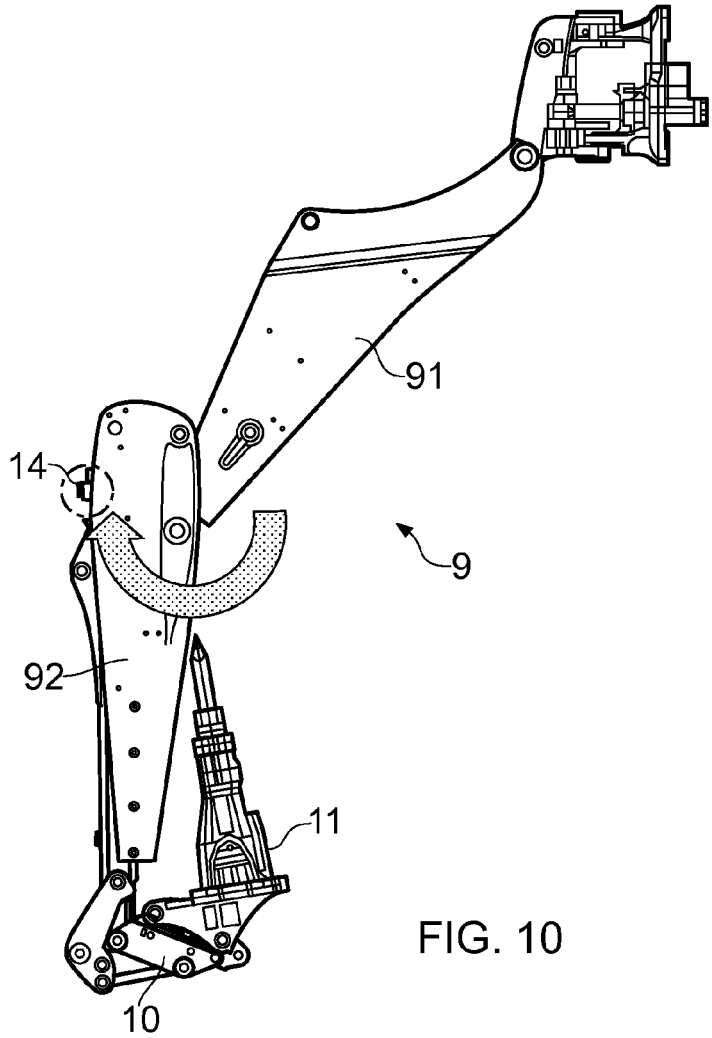
Figure 10A:
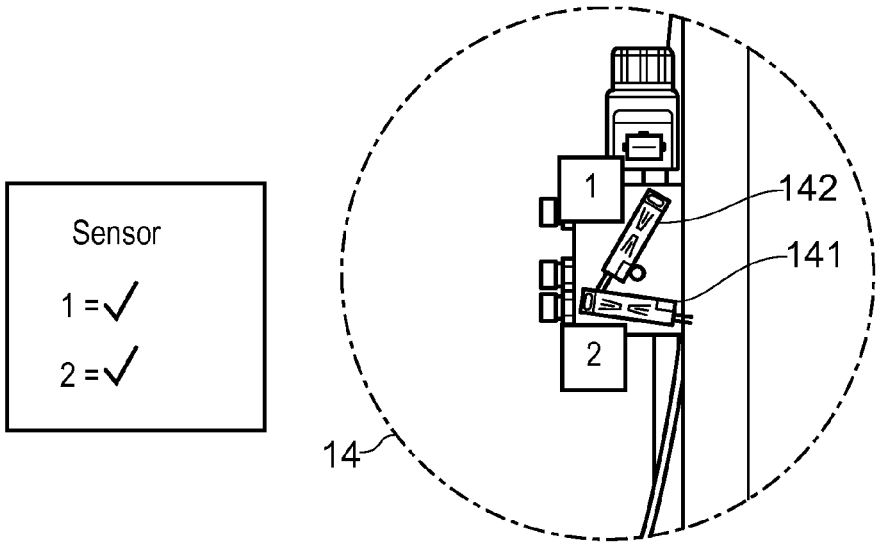
Figures 11, 11A:
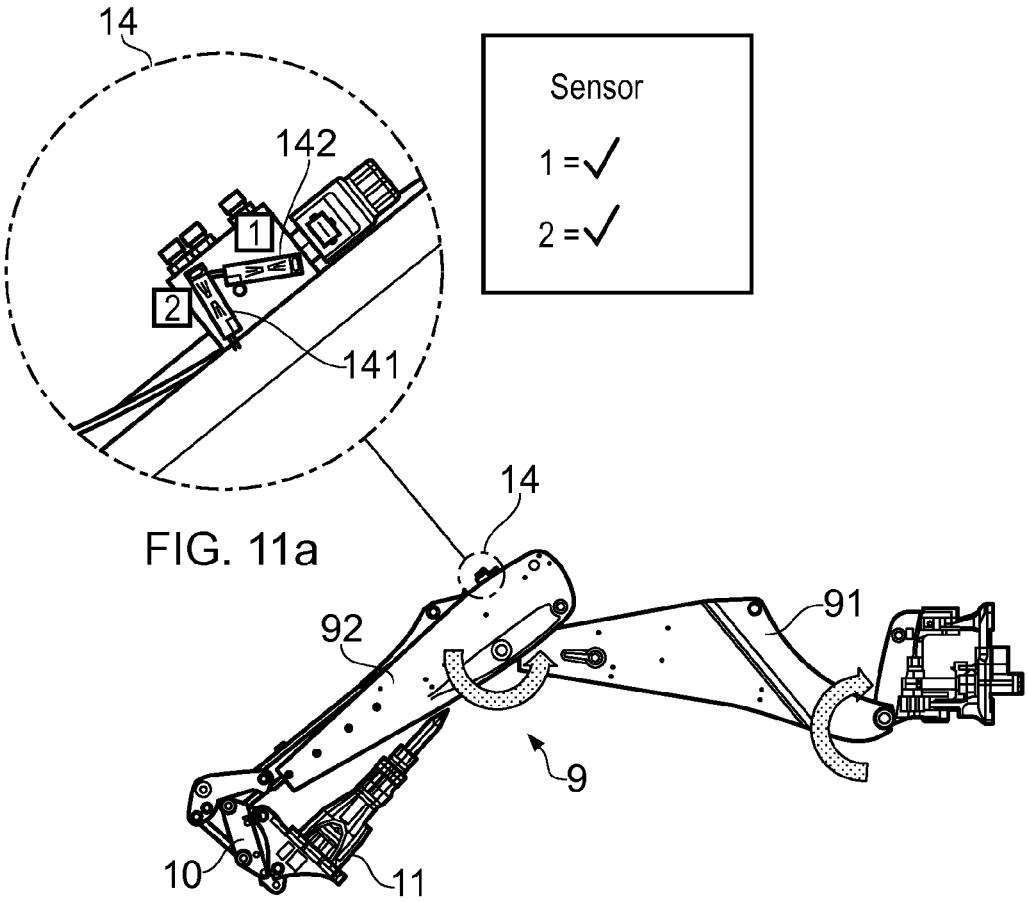
Figure 12A:
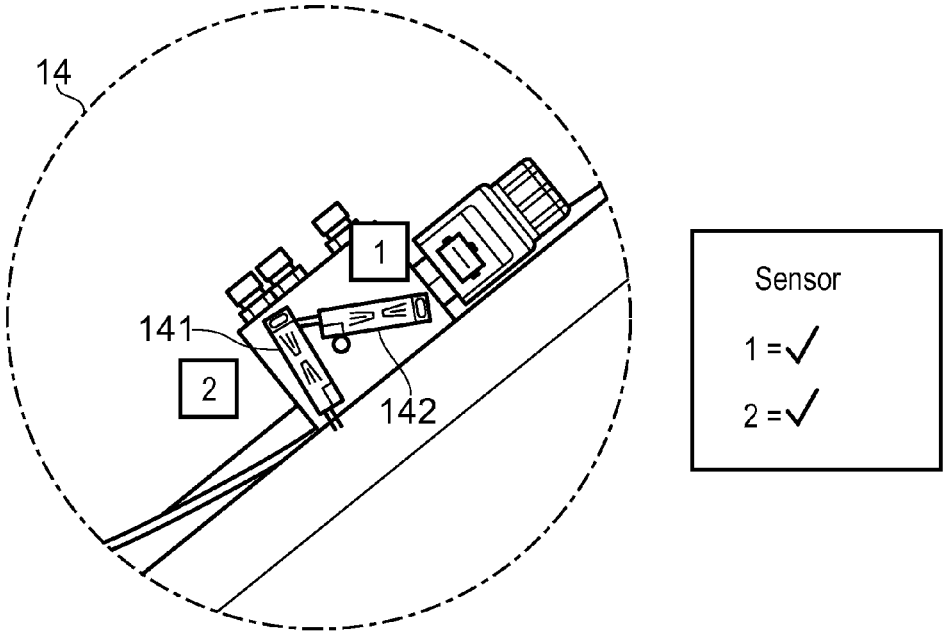
Figure 12:
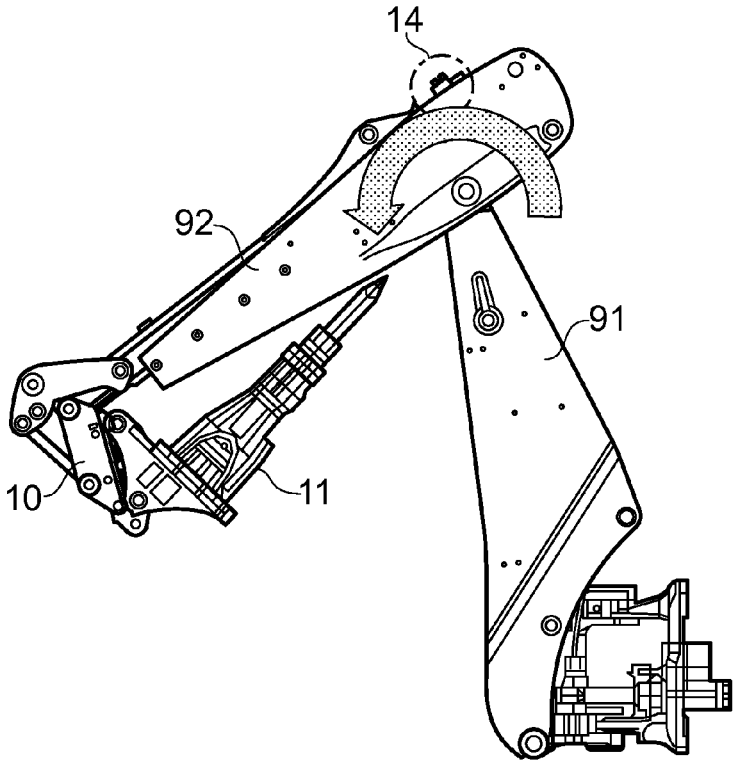

The configuration of the second hitch arrangement 10 may be such that the operation of the second hitch arrangement control circuit 101 as described above will prevent or substantially prevent the second working implement 11 from falling from the second hitch arrangement 10 under the effect of gravity when the second working arm 9 is extended to its maximum height—as shown in FIG. 8. In other words, the second hitch arrangement 10 is configured such that, when the second working arm 9 and the second working implement 11 are in this position, gravity will tend to force a pin of the second working implement 9 into the or each first hook or the or each second hook or recess of the second hitch arrangement 10—so that the second working implement 9 remains substantially attached to the second hitch arrangement 11.

The one or more sensors 16 may, in an embodiment, include a dipper arm and boom sensor arrangement 14. The dipper arm and boom sensor arrangement 14 is configured to sense a position (for example, an orientation) of the sensor arrangement 14 with respect to gravity or the main body 5 of the machine 1. The dipper arm and boom sensor arrangement 14 is configured to output a signal to indicate that the dipper arm 92 and/or the boom 91 are in a permitted orientation with respect to gravity, with respect to each other, or with respect to the main body 5 of the machine 1 for movement of the closure arrangement of the second hitch arrangement 10 from the closed to the open position to occur in a substantially safe manner (for a known or assumed position of the second working implement 11—which may be determined by the first sensor and which may be the second working implement position).

The dipper arm and boom sensor arrangement 14 may comprise a second sensor 141 and a third sensor 142 which have sensing axes which are rotationally offset with respect to each other, with both sensors 141 and 142 preferably being in a single plane of the second working arm 10.

The second 141 and third 142 sensors may be first 141 and second 142 tilt switches which are each configured to conduct an electrical signal therethrough when in respective acceptance orientations and which are each configured to prevent the conduction of an electrical signal therethrough when the switches 141,142 are outside a respective acceptable orientation. The acceptable orientations are, in this embodiment, ranges of angular positions with respect to gravity which are determined, for each of the second 141 and third 142 sensors, by the orientation of the sensing axes thereof.

In an embodiment in which the second 141 and third 142 sensors are first 141 and second 142 tilt switches respectively, the tilt switches 141, 142 may be electrically connected in series such that an electrical signal transmitted along a first conductor to the switches 141, 142 will only be conducted through the switches 141, 142 to a second conductor if both switches 141, 142 are closed—because both switches 141, 142 are within their respective permitted orientations with respect to gravity. When one or both of the switches 141, 142 are not within their respective permitted orientations with respect to gravity, then the or both switches will be open and will prevent or substantially prevent the conduction of an electrical signal from the first conductor to the second conductor. The first and second conductors may be in electrical communication with the second hitch arrangement control circuit 101. The second hitch arrangement control circuit 101 may be configured to output an electrical signal on the first conductor and to sense receipt of a signal on the second conductor. As will be appreciated, the sensing of a signal on the second conductor is an indication that the first 141 and second 142 tilt switches are orientated in their respective permitted orientations with respect to gravity (and the tilt switches 141, 142 are closed).

In an embodiment, the dipper arm and boom sensor arrangement 14 is attached to the dipper arm 92. In an embodiment, the dipper arm and boom sensor arrangement 14 is attached to the boom 91. In an embodiment, the dipper arm and boom sensor arrangement 14 is at least partially attached to both the dipper arm 92 and the boom 91. In an embodiment, the dipper arm and boom sensor arrangement 14 is at least partially attached to the main body 5 of the machine 1.

In an embodiment in which the dipper arm and boom sensor arrangement 14 comprises second 141 and third 142 sensors, the sensors 141, 142 may be attached to the dipper arm 92 only or may be attached to the dipper arm 92 and boom 91. The second sensor 141 may be attached to the dipper arm 92 only and the third sensor 142 may be attached to the boom 91 only.

In an embodiment, the second sensor 141 is configured to sense whether or not the dipper arm 92 is in an acceptable orientation with respect to gravity or the main body 5 of the machine 1. In an embodiment, the third sensor 142 is configured to sense whether or not the boom 91 is an acceptable orientation with respect to gravity or the main body 5 of the machine 1. It will be appreciated that the acceptable orientations of the dipper arm 92 and boom 91 are such that when the dipper arm 92 and boom 91 are both in their respective permitted orientations, it is considered unlikely that the moving of the closure arrangement of the second hitch arrangement 10 to the open position will cause the second working implement 11 to fall from the second hitch arrangement 10 under the effect of gravity in an undesired manner (for a given position of the second working implement 11 such as the second working implement position which may be sensed by the first sensor).

The dipper arm and boom sensor arrangement 14 may compromise one or more sensors which are configured to sense the orientation of the dipper arm 92 with respect to the boom 91. The dipper arm and boom sensor arrangement 14 may further comprise one or more sensors which are configured to sense the orientation of the boom 91 with respect to the main body 5 of the machine 1. The sensors of the dipper arm and boom sensors arrangement 14 may, in these embodiments, include an optical or magnetic absolute encoder. The absolute encoders may be rotary absolute and may be located at the pivot joint between the dipper arm 92 and boom 91 and between the boom 91 and main body 5 of the machine 1 respectively. The absolute encoders may be linear absolute encoders which are coupled to or a part of the hydraulic driving arrangement 63 for the second working arm 9.

The dipper arm and boom sensor arrangement 14 may issue a signal to the second hitch arrangement control circuit 101 when the permitted orientation is detected. The dipper arm and boom sensor arrangement 14 may issue a signal which is indicative of the orientation of the dipper arm 92 and/or boom 91 with respect to gravity or the main body 5 of the machine 1; the second hitch arrangement control circuit 101 may be operable to receive the signal and determine if the orientation of the dipper arm 92 and/or boom 91 is a permitted orientation for allowing movement of the closure arrangement of the second hitch arrangement 10 to the open position (for a known position of the second working implement 11).

The issuance of a signal by the dipper arm and boom sensor arrangement 14 of any part thereof as discussed above may comprise the alteration of a continuous or substantially continuous signal.

As will be appreciated, what is considered to be a safe or permitted orientation/position of the dipper arm 92 and/or boom 91 to allow the closure of the second hitch arrangement 10 to open will depend on the configuration of the second hitch arrangement 10 and the intended operation of the second hitch arrangement 10 during the process of detaching the second working implement 11 therefrom. In addition, a position of the second working implement 11 with respect to the dipper arm 92 or boom 91 must also be known and this may be acquired by use of the first sensor.

It will be appreciated that many different arrangements of dipper arm and boom sensor arrangement 14 are possible and that these may be attached to parts of the machine 1 in various different manners and according to various different arrangements. It will be further appreciated that the second working arm 10 may be of different geometries and configurations. Thus, in an embodiment, the second working arm 10 may comprise a boom only or may comprise a plurality of arm sections. The one or more sensors 16 may, in an embodiment, include a sensor to sense the position (for example, an orientation) of a part of the second working arm 10 with respect to gravity or with respect to another part of the second working arm 10. Indeed, according to an embodiment, the second working arm 10 may be of a configuration similar to that of the first working arm 6.

Of course, determining the orientation of the second working implement 11 with respect to the dipper arm 92, and the orientation of the dipper arm 92 and boom 91 with respect to gravity allows the position of the second working implement 11 with respect to gravity to be determined. Therefore, in an embodiment, the one or more sensors comprises a sensor arrangement which determines the orientation of the second working implement 11 (and/or the whole or a part of the second hitch arrangement 10) with respect to gravity. This sensor arrangement may comprise, for example, the first, second and third sensors, or one of the other arrangements described herein or may comprise a one or more sensors which are attached to the second hitch arrangement 10 and/or second working implement 11 and which are configured to determine the orientation of the second working implement 11 with respect to gravity without determining the orientation of the dipper arm 92 or boom 91 (the one or more sensors may then issue a signal to the second hitch arrangement control circuit 101).

In accordance with embodiments of the present invention, if the second working arm 9 and/or second working implement 11 are in permitted positions (which may be permitted orientations), then the second hitch arrangement control circuit 101 may allow the closure arrangement of the second hitch arrangement 10 to move to the open position on actuation of a user operable control 13. If the second working arm 9 and second working implement 11 are not in permitted positions (which may be orientations), then the second hitch arrangement control circuit 101 may prevent the closure arrangement of the second hitch arrangement from moving to the open position on actuation of a user operable control 13.

In accordance with embodiments of the present invention including a locking pin or other locking arrangement in the second hitch arrangement 10, if the second working arm 9 and second working implement 11 are in permitted orientations, then the second hitch arrangement control circuit 101 may permit the locking pin or other locking arrangement to move to the unlocked position on actuation of a user operable control 13. If the second working arm 9 and second working implement 11 are not in permitted orientations, then the second hitch arrangement control circuit 101 may prevent the movement of the locking pin or other locking arrangement from the locked to the unlocked position on actuation of a user operable control 13.

The second hitch arrangement control circuit 101 determines if the second working arm 9 and second working implement 11 are in permitted orientations based on signals received by the circuit 101 from the one or more sensors.

In accordance with embodiments of the present invention, if the second working arm 9 and second working implement 11 are in permitted positions (which may be orientations), then the second hitch arrangement control circuit 101 may provide the user with an indication that it is considered to be safe for the closure arrangement of the second hitch arrangement 10 to move to the open position on actuation of a user operable control 13. If the second working arm 9 and second working implement are not in permitted position (which may be orientations), then the second hitch arrangement control circuit 101 may provide the user with an indication that it is not considered to be safe for the closure arrangement of the second hitch arrangement 10 to move to the open position on actuation of a user operable control 13. The indication may be a visual indication (e.g. a light which is lit or extinguished) in the operator cab 12 and/or may be an audible indication (e.g. an alarm which is sounded or not) in the operator cab 12.

If the closure of the second hitch arrangement 10 is already open and the second hitch arrangement control circuit 101 detects movement of the second working arm 9 or second working implement 11 towards a position (which may be an orientation) which is considered to be unsafe (i.e. not permitted), then movement of the second working arm 9 and/or second working implement 11 into the unsafe position may be prevented by the second hitch arrangement control circuit 101 or the user may be provided with an indication.

The second hitch arrangement control circuit 101 may detect a control signal actuated by a user which indicates that the user intends to move the second working arm 9 or second working implement 11 rather than detecting actual movement of the second working arm 9 or second working implement 11.

FIGS. 9-15 show an embodiment of the second working arm 9 and second working implement 11 in various positions.

In FIGS. 9, 10, 11 and 12, rotational movement of the dipper arm 92 in the direction shown with respect to the boom 91 is interpreted by the second hitch arrangement control circuit 101 as a safe movement and the closure arrangement of the second hitch arrangement 10 is permitted to move to or remain in the open position if this movement occurs (and the movement may be permitted if the closure is in the open position).

Figure 13:
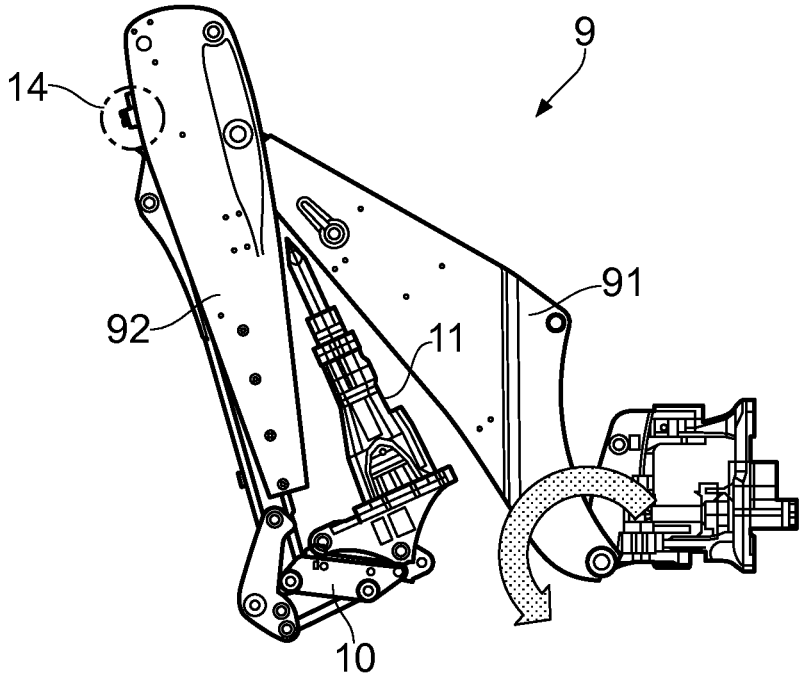
Figure 13A:
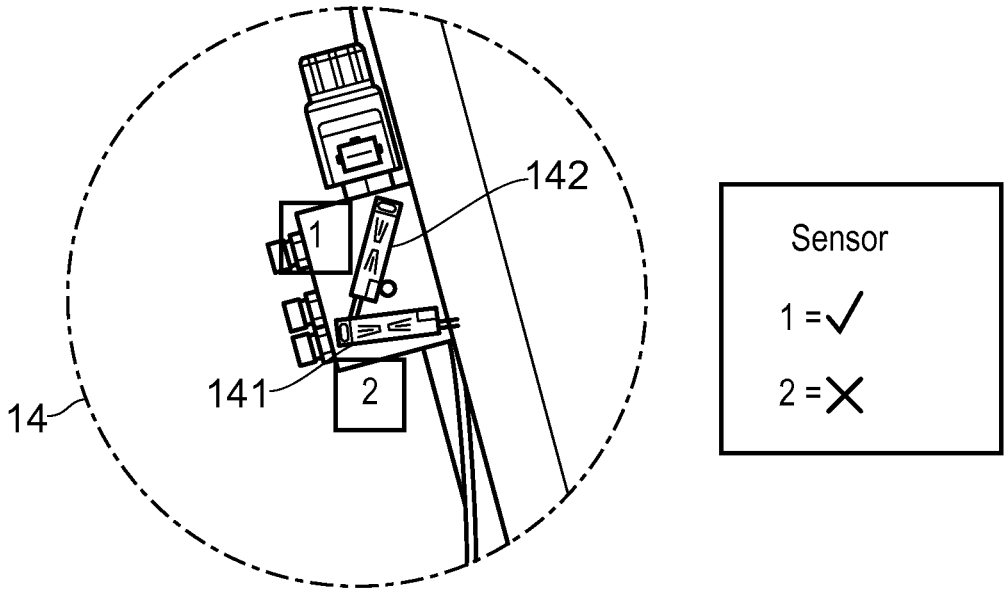
Figure 14:
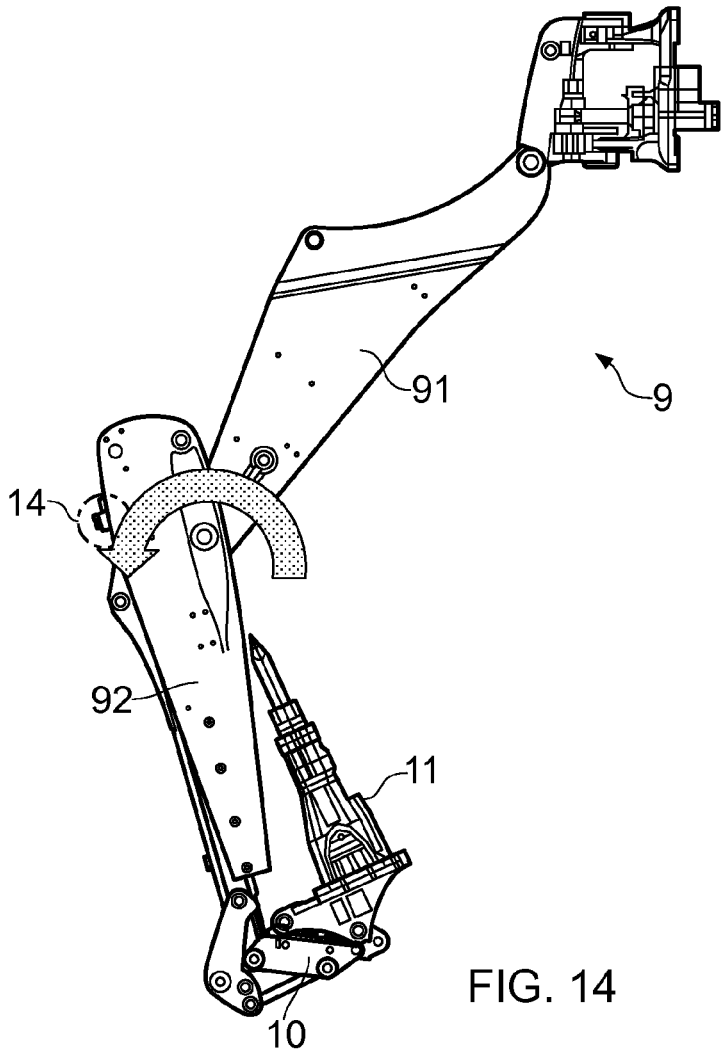
Figure 14A:
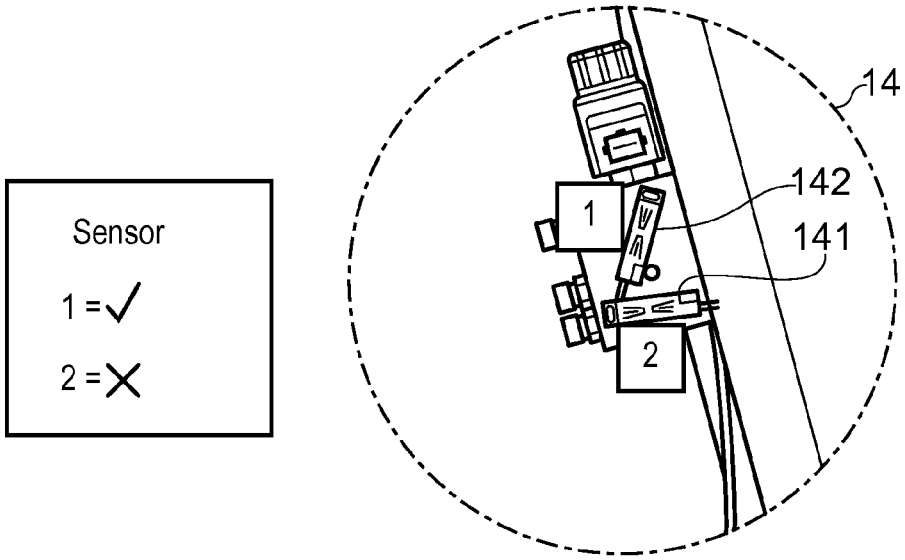
Figure 15A:
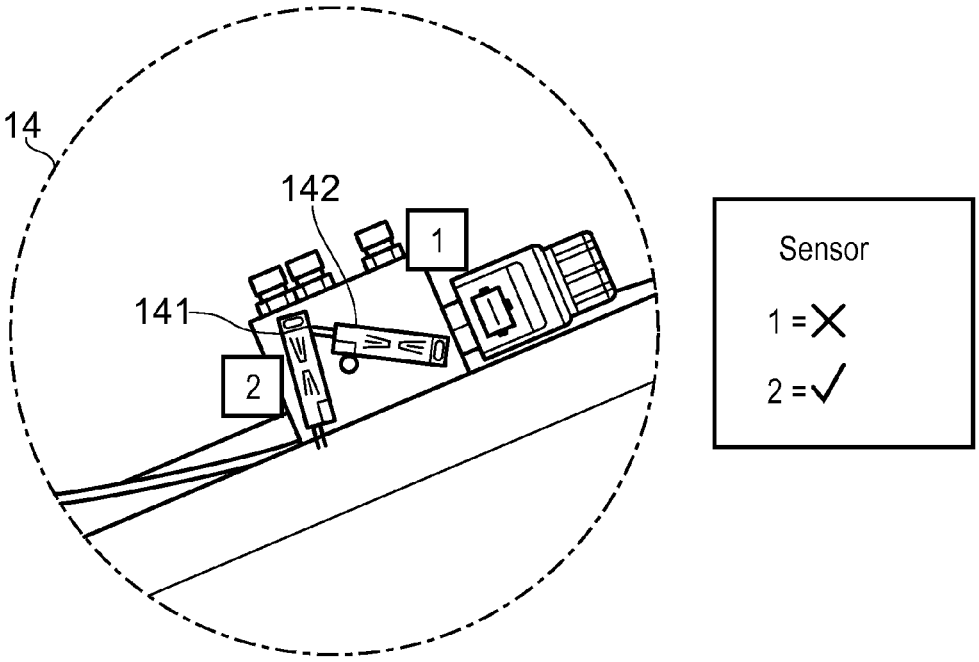
Figure 15:
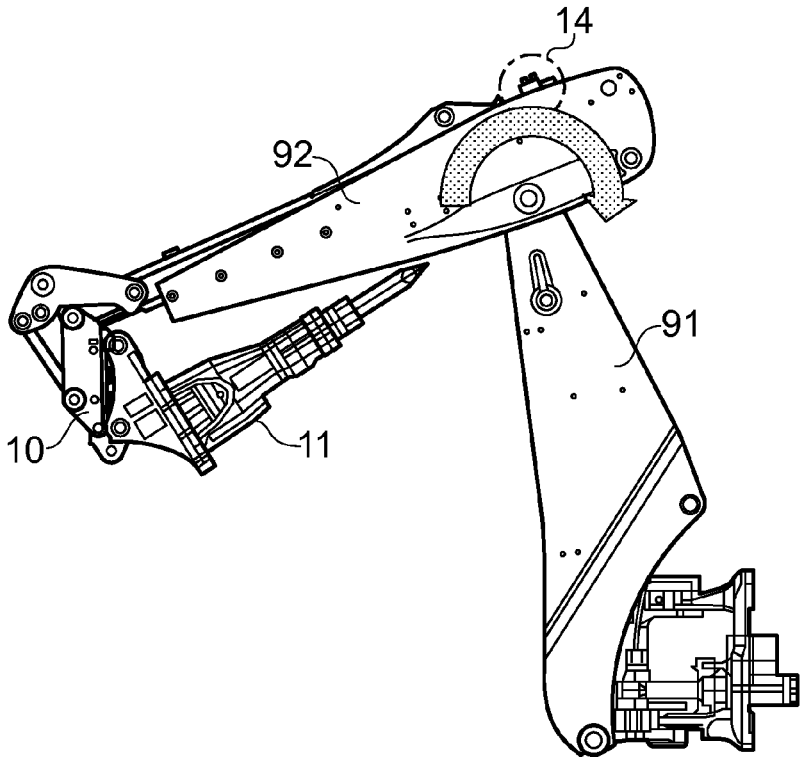

In FIGS. 13, 14 and 15, rotational movement of the dipper arm 92 in the direction shown with respect to the boom 91 is interpreted by the second hitch arrangement control circuit 101 as an unsafe movement and the closure arrangement of the second hitch arrangement 10 is closed or allowed to remain closed if this movement occurs (and movement may not be permitted if the closure arrangement is in the open position).

FIGS. 8*a*, 9*a*, 10*a*, 11*a*, 12*a*, 13*a*, 14*a* and 15*a* show representations of tilt switches forming part of the dipper arm and boom position sensor arrangement 14 as described herein in relation to embodiments of the present invention. These figures show whether or not the tilt switches 141, 142, with the dipper arm 92 and boom 91 in the orientation shown in the respective associated figure (FIGS. 8, 9, 10, 11, 12, 13 and 14), are in a configuration to conduct (represented by a tick) or block (represented by a cross) an electrical signal applied therethrough.

For the avoidance of doubt, in an embodiment, the detachment procedure for the second working implement 11 from the second hitch arrangement 10 generally comprises extending the third hydraulic ram 931, moving the dipper arm 92 and boom 91 such that the second working implement 11 is positioned generally above the second hitch arrangement 10 with respect to gravity. With the dipper arm 92, boom 91, and second working implement 11 in this position, the closure arrangement of the second hitch arrangement 10 is moved from the closed to the open position. The third hydraulic ram 931 is then operated to rotate the second working implement 11 with respect to the dipper arm 92 away from the dipper arm 92 and towards the ground surface 4. The second working implement 10 is placed on the ground surface before the orientation of the second working implement 11 with respect to the second hitch arrangement 10 becomes such that the second working implement 11 is released entirely from the second hitch arrangement 10. Once the weight of the second working implement 11 is supported by the ground surface 4, then the second hitch arrangement 10 (and potentially also the dipper arm 92 and/or the boom 91) is moved such that the second working implement 11 is entirely released from the second hitch arrangement 10.

Embodiments of the present invention must, therefore, allow the second working implement 11 to be detached from the second hitch arrangement 10 when desired or when it is considered safe to do so. Therefore, the permitted positions of the second working arm 9 and second working implement 11 may include positions (which may be orientations) in which the above operation can be performed.

Embodiments of the present invention have been described with reference to the second working arm 9, second hitch arrangement 10, and second working implement 11 of a working machine 1. As mentioned above, a working machine may only have the second working arm 9. Furthermore, embodiments of the present invention include working machines which have a plurality of working arms which are working arms in accordance with the above description of the second working arm.

It will be appreciated that the one or more sensors and the second hitch arrangement control circuit 101 form part of a hitch safety arrangement. Furthermore, the second hitch arrangement control circuit 101 may form part of a control module.

It has been assumed herein that the control module is an electrical control module. However, it will be appreciated, that the control module may operate hydraulically or pneumatically—for example. The control module may receive one or more signals and use the or each signal to determine if the position of the second working arm 9 and/or second working implement 11 is a permitted or an unpermitted position. This determination may require comparison of the or each signal to one or more signals or combinations of signals stored in a look-up table of the control module.

It will be appreciated that, if the orientation of part of the second working arm 9 or second hitch arrangement 10 or second working implement 11 is known with respect to the main body 5 of the machine 1, and it is assumed that the main body 5 of the machine 1 has a fixed orientation with respect to gravity (e.g. it is assumed that the main body 5 of the machine 1 is on level ground) or the orientation of the main body 5 of the machine 1 with respect to gravity is known or substantially known (e.g. using a sensor), then the orientation of that part of the second working arm 9 or second hitch arrangement 10 or second working implement 11 can be determined with respect to gravity. This may be performed by the second hitch arrangement control circuit 101 or may be taken into consideration when selecting the permitted orientations, positions and orientations of the one or more sensors and the like.

The second hitch arrangement control circuit 101 may be connected to the second working arm hydraulic driving arrangement 93 or a part thereof and configured to prevent or permit movement of the hydraulic driving arrangement 93 or a part thereof.

The second hitch arrangement control circuit 101 may be connected to the one or more user operable controls 13 which are configured to control the actuation of the second working arm hydraulic driving arrangement 93 and/or parts thereof.

It will be appreciated that, as used herein, a "signal" refers to the transmission of information and this may be achieved in an electrical system in the change of a voltage and/or current or in a fluid system (e.g. hydraulic or pneumatic) in the change of a fluid flow or pressure.

According to embodiments, the one or more sensors 16 may each comprise one or more Hall effect sensors and/or one or more Reed switches and/or one or more mercury switches and/or one or more proximity sensors, or the like.

In an embodiment, the one or more sensors 16 are configured to determine an orientation of a second working implement 10 secured to the second hitch arrangement 11 and the second hitch arrangement 11 with respect to gravity and to output a signal indicative of the orientation of the second working implement 10 and the second hitch arrangement 11 with respect to gravity.

One advantage of embodiments of the present invention over the working machines of the prior art is that the intelligence is in the machine rather in the hitch itself.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A working machine comprising:

a working arm;

a hitch arrangement attached to the working arm and configured to be removably secured to a working implement;

one or more sensors configured to determine an orientation of a working implement secured to the hitch arrangement and to output a signal indicative of the orientation of the working implement secured to the hitch arrangement with respect to gravity;

a control module configured to receive the signal from the one or more sensors, the control module further configured to detect whether the hitch arrangement is in a permitted orientation or an unpermitted orientation, wherein the permitted orientation is a position where the working implement is less likely to fall from the hitch arrangement, and the unpermitted orientation is a position where the working implement is more likely to fall from the hitch arrangement, and the control module being further configured to perform a safety function in response to receipt of the signal such that the safety function is performed if the orientation of a working implement secured to the hitch arrangement with respect to gravity is an unpermitted orientation; and a user operable control coupled to the hitch arrangement and configured to actuate a closure of the hitch arrangement between an open position and a closed position, the closure being adapted to releasably secure the working implement to the hitch arrangement, wherein the safety function includes preventing the closure from moving from the closed position to the open position.

2. A machine according to claim 1, wherein the one or more sensors include a sensor to determine a likely orientation of the working implement secured to the hitch arrangement by sensing an orientation of the hitch arrangement.

3. A machine according to claim 1, wherein the working arm comprises a boom and a dipper arm, the hitch arrangement is attached to a distal end of the dipper arm, and the one or more sensors comprise a first sensor configured to issue a signal indicative of a position of at least part of the hitch arrangement with respect to the dipper arm, and a sensor arrangement configured to issue a signal indicative of a position of the dipper arm and boom with respect to gravity.

4. A machine according to claim 1, further comprising a user indicator configured to output an indication to a user, wherein the safety function includes changing output indication to the user.

5. A machine according to claim 4, wherein the output includes a visual output.

6. A machine according to claim 4, wherein the output includes an audio output.

7. A machine according to claim 1, wherein the one or more sensors include one or more tilt switches.

8. A machine according to claim 1, wherein the one or more sensors include one or more absolute encoders.

9. A machine according to claim 1, wherein the signal from the one or more sensors comprises an electrical signal.

10. A machine according to claim 1, wherein the one or more sensors are configured to determine an orientation of a working implement secured to the hitch arrangement and to output a plurality of signals each indicative of the orientation of a part of the working arm and/or a working implement secured to the hitch arrangement with respect to gravity.

11. A machine according to claim 1, wherein the control module determines whether the orientation of a working implement secured to the hitch arrangement with respect to gravity is the permitted orientation or the unpermitted orientation based on the or each received signal.

12. A machine according to claim 1, wherein the machine is an excavator.

13. A machine according to claim 1, wherein the machine is a backhoe loader.

* * * * *